United States Patent [19]

Fults

[11] 4,017,408

[45] Apr. 12, 1977

[54] WATER SOLUBLE LIQUID IODINE CONCENTRATE, AQUEOUS IODINE BACTERIOCIDAL SOLUTION AND METHODS OF MAKING THE SAME

[76] Inventor: Elmer H. Fults, 219 Woodward Drive, Tulare, Calif. 93274

[22] Filed: July 14, 1975

[21] Appl. No.: 595,560

[52] U.S. Cl. ..... 252/106; 424/150; 424/337

[51] Int. Cl.[2] ..... C11D 3/34; C11D 3/48

[58] Field of Search ..... 252/106; 424/150, 337

[56] References Cited

UNITED STATES PATENTS

| | | | |
|---|---|---|---|
| 2,599,140 | 6/1952 | Taub | 252/121 |
| 2,759,869 | 8/1956 | Sutton et al. | 252/107 X |
| 2,931,777 | 5/1960 | Shelanski | 252/106 |
| 3,551,554 | 12/1970 | Herschler | 424/7 |
| 3,650,966 | 3/1972 | Bakka | 252/106 |
| 3,654,165 | 4/1972 | Bryant et al. | 252/90 |

OTHER PUBLICATIONS

Soda et al., The Journal of Physical Chemistry, vol. 71, No. 13, Dec. 1967.

*Primary Examiner*—P.E. Willis, Jr.
*Attorney, Agent, or Firm*—Huebner & Worrel

[57] ABSTRACT

A water soluble liquid iodine concentrate consisting of iodine, dimethyl sulfoxide, and a liquid detergent in solution; an iodine bacteriocidal composition consisting of said concentrate in aqueous solution; and methods for making said concentrate and composition including the steps of complexing iodine, dimethyl sulfoxide and a liquid detergent.

3 Claims, No Drawings

WATER SOLUBLE LIQUID IODINE CONCENTRATE, AQUEOUS IODINE BACTERIOCIDAL SOLUTION AND METHODS OF MAKING THE SAME

BACKGROUND OF THE INVENTION

1. Field of the Invention

The present invention relates to a water soluble liquid iodine concentrate comprising iodine, dimethyl sulfoxide, and a liquid detergent in solution; an iodine bacteriocidal composition comprising said concentrate in aqueous solution; and methods for making said concentrate and composition.

The efficacy of iodine as a bacteriocidal cleaning and sanitizing agent has long been recognized. Minute quantities in aqueous solution have long been used for germicidal purposes on animals, especially man, and in cleansing and sanitizing furniture, fixtures, instruments and the like.

2. Description of the Prior Art

It is common knowledge that iodine is a solid material which is relatively insoluble in water and other solvents. The best prior practices have only been able to attain dilute aqueous solutions and then only with considerable trouble, time, and expense. Commercially, it has been the practice to cook solid iodine at elevated temperatures over long periods of time in synthetic detergents to dissolve the iodine into the detergents. Such procedures have been hazardous, produce undesirable iodinated by-products and fuming. Further, such procedures have resulted in excessive iodine loss by the production of undesirable iodine compounds and by the escape of the fuming iodine. Further, the most concentrated iodine solutions attainable have been highly diluted.

While the "Hot Processes" for forming iodine solutions have dominated commercial iodine production, there have been other procedures of varying efficacy. However, none has produced an iodine concentrate suitable for storing and transportation which can be quickly and easily dissolved in water for use.

U.S. Pat. No. 2,599,140 relates to a disinfecting detergent containing iodine in which the maximum of elemental iodine in the composition is 10% and the maximum of alkali metal iodine is 15%.

The iodine detergent solution of U.S. Pat. No. 3,274,116 achieves a concentration of from one to five percent by weight of free iodine in water.

U.S. Pat. No. 3,355,386 relates to germicidal nonionic-detergent iodine compositions and is primarily concerned with color enhancement. Even at elevated temperatures of 50° C. the maximum iodine concentration appears to be 25%.

U.S. Pat. No. 3,438,905 discloses an iodine-containing non-ionic surfactant composition. Even though the mixtures taught by the patent are heated to elevated temperatures of from 50° to 150° C. for protracted periods, only dilute solutions of iodine are achieved.

The enhancing tissue penetration of physiologically active agents with DMSO of U.S. Pat. No. 3,551,554 is largely concerned with the utilization of DMSO as a carrier for physiologically active steroids, antineoplastic agents, antigens, and the like. The patent teaches that DMSO can be employed as a penetrating carrier for iodine but in no respect suggests that DMSO can be utilized to achieve concentrated iodine solutions.

U.S. Pat. No. 3,654,165 discloses a telephone cleaner-sanitizer which contains minute quantities of iodine.

Thus, it will be seen that the prior art has produced only dilute iodine solutions. While such dilute solutions are highly effective for bacteriocidal, sanitizing and cleansing purposes, they require vast quantities of water for diluent purposes, making storage and transportation, space consuming, laborious and expensive. Further, prior to the present invention, solutions of iodine were generally difficult to achieve, expensive to produce, and in many instances not as stable as desired.

SUMMARY OF THE INVENTION

The broad essence of the present invention resides in the discovery that highly concentrated iodine solutions can be achieved which are readily water soluble without requiring elevated temperatures and the undesirable consequences thereof.

An object of the present invention is to provide a liquid containing a high iodine concentration which is readily soluble in water.

Another object is to transport and store iodine in concentrated liquid form which is readily soluble in water.

Another object is to produce a concentrated liquid iodine at ambient temperatures.

Another object is to provide an improved solution of iodine capable of containing greater concentrations of iodine than previously attainable.

Another object is to provide an aqueous iodine solution having improved bacteriocidal, sanitizing, and cleansing properties.

Another object is substantially to reduce the cost of iodine concentrations and solutions.

Further objects and advantages will become apparent in the subsequent description in the specification.

In the practice of the present invention, iodine $I_2$ is dissolved in dimethyl sulfoxide, $CH_3SOCH_3$, sometimes written $(CH_3)_2SO$, at ambient temperature with moderate agitation or stirring. The solid iodine rapidly becomes a flowable liquid so that an iodine-dimethyl sulfoxide system is achieved in only a few minutes. The maximum concentration of elemental iodine to dimethyl sulfoxide occurs at approximately 7.3 parts by weight iodine and 2.7 parts by weight dimethyl sulfoxide. Expressed differently, the maximum practical concentration at ambient temperature of elemental iodine in dimethyl sulfoxide is achieved when the amount of iodine in the system is 270% of the dimethyl sulfoxide by weight or when the dimethyl sulfoxide is present in at least about 37% by weight of the iodine. The amount of dimethyl sulfoxide in relation to the elemental iodine can be increased, as desired. The resultant iodine concentrate is adapted when mixed with a water soluble liquid detergent rapidly to form a dilute iodine solution in water. Because of its concentration, the concentrate permits the much more economical storage and transportation of iodine which subsequently can be diluted in aqueous solution to provide whatever diluted concentration is desired.

The elemental iodine in the concentrate combines with dimethyl sulfoxide to form a fluid organic complex which is flowable and non-separating.

The dimethyl sulfoxide is sometimes known as methylsulfinylmethane and is a water-white liquid at room temperature having a freezing point of approximately 18.5° C. and a specific gravity of approximately 1.1. It has probably been best known as a penetrating agent capable of carrying physiologically active agents in improved tissue penetration, particularly the skin and mucous membranes of the body cavities.

When it is desired to convert the concentrate into an aqueous solution, the concentrate is dissolved in a detergent which is nonionic, anionic or a combination of nonionic and anionic detergents. The preferred water soluble detergents are the following surfactants:

1. Triton X-100 of the Rohm & Haas (isooctyl polyethoxey ethanol containing 10 mols of ethylene oxide).
2. Triton X-102, a trademark of Rohm & Haas (octyl phenoxy polyethoxy ethanol containing 12–13 moles ethylene oxide).
3. Alkyl aryl sulfonates such as Nacconal 60 (a trademark of National Aniline Division of Allied Chemical and Dye Corporation which designates the group of alkyl aryl sulfonates by U.S. Pat. Nos. 1,970,578 and 2,213,477).
4. Fulsan 70 (a sodium linear alkylbenzene sulfonate, and sodium alcohol ethoxysulfate and alcohol ethoxylate).
5. Wyandotte Pluronic L-64 (a trademark of Wyandotte Chemicals Corp. consisting of 10% polyoxyethylene and 60% polyoxypropylene, having an average molecular weight of 2,900 as disclosed in U.S. Pat. No. 2,674,169).
6. Wyandotte Pluronic L-62 (a trademark of Wyandotte Chemicals Corp. consisting of 20% polyoxyethylene and 80% polyoxypropylene, having an average molecular weight of 2,500, as disclosed in U.S. Pat. No. 2,674,169.
7. Wyandotte Pluronic L-61 (a trademark of Wyandotte Chemicals Corp. consisting of 10% polyoxyethylene and 90% polyoxypropylene, having an average molecular weight of 2,000, as disclosed in U.S. Pat. No. 2,674,169.

DESCRIPTION OF THE PREFERRED EMBODIMENTS

The following examples illustrate the practice of the present invention with various proportions of the iodine and dimethyl sulfoxide and in several instances with various classes and quantities of surfactants. The examples are by way of illustration and not of limitation. The proportions given are by weight unless otherwise designated.

Example 1

| Concentrate of Highest Practical Iodine Concentration At Ambient Temperatures | |
|---|---|
| Iodine | 73 |
| Dimethyl sulfoxide | 27 |

Excellent for storage and transportation. Readily dissolved in water by the addition of a nonionic, anionic, or combined nonionic anionic surfactant and water.

Example 2

| Aqueous Free Iodine Concentrate | |
|---|---|
| Iodine | 70 |
| Dimethyl sulfoxide | 30 |

Slightly easier to attain than Example 1. Excellent for storage and transportation. Readily dissolved in water by use of surfactant.

Example 3

| Aqueous Free Iodine Concentrate | |
|---|---|
| Iodine | 60 |
| Dimethyl sulfoxide | 40 |

An excellent flowable liquid iodine of greater iodine concentration than previously attainable. Readily dissolved in water, as noted.

Example 4

| Aqueous Free Iodine Concentrate | |
|---|---|
| Iodine | 50 |
| Dimethyl sulfoxide | 50 |

An excellent flowable liquid iodine of greater iodine concentration than previously attainable. Readily dissolved in water, as noted.

Example 5

| Aqueous Free Iodine Concentrate | |
|---|---|
| Iodine | 40 |
| Dimethyl sulfoxide | 60 |

An excellent flowable liquid iodine of greater iodine concentration than previously attainable. Readily dissolved in water, as noted.

Example 6

| Aqueous Free Iodine Complex | |
|---|---|
| Iodine | 10 |
| Dimethyl sulfoxide | 90 |

A useful complex but having an iodine concentration within the range attainable by prior art practices including the "hot" processes but easier and more economical to produce.

Example 7

| Iodine Concentrate Conditioned For Dissolution in Water | |
|---|---|
| Iodine | 70 |
| Dimethyl sulfoxide | 30 |
| Bio D surfactant | 50 |

Example 8

| Iodine Concentrate Conditioned For Dissolution In Water | |
|---|---|
| Iodine | 60 |
| Dimethyl sulfoxide | 40 |
| Pluronic L-64 | 40 |

Example 9

| Iodine Concentrate Conditioned For Dissolution In Water | |
|---|---|
| Iodine | 200 |
| Dimethyl sulfoxide | 200 |
| Pluronic L-62 | 200 |

Example 10

| Iodine Concentrate Conditioned For Dissolution In Water | |
|---|---|
| Iodine | 160 |
| Dimethyl sulfoxide | 240 |
| Triton X-102 | 80 |

Example 11

| Iodine Concentrate Conditioned For Dissolution In Water | |
|---|---|
| Iodine | 300 |
| Dimethyl sulfoxide | 500 |
| Triton X-100 | 500 |

Example 12

| Iodine Concentrate Conditioned For Dissolution In Water | |
|---|---|
| Iodine | 250 |
| Dimethyl sulfoxide | 110 |
| Fulsan-70 (70% active surfactant) | 140 |

A liquid containing 41.12% iodine determined by titration and like all the other examples formed without objectionable fuming or elevated temperatures.

Example 13

| An Aqueous Bacteriocidal Composition | |
|---|---|
| The Concentrate of Example 2 | 2 |
| Bio D surfactant | 19.6 |
| Water | 78.4 |

Contains 1.09% available iodine and can be readily diluted to 25 ppm. or other desired level for use as a sanitizing solution.

Example 14

| An Aqueous Bacteriocidal Composition | |
|---|---|
| The Concentrate of Example 3 | 2 |
| Pluronic L-64 | 19.6 |
| Water | 78.4 |

Water soluble iodine solution containing 8,300 ppm. of iodine and suitable for bovine teat dip.

Example 15

| An Aqueous Bacteriocidal Composition | |
|---|---|
| The Concentrate of Example 4 | 4 |
| Pluronic L-64 | 19.2 |
| Water | 76.8 |

A water soluble solution containing 1.64% available iodine. Can be diluted to 25 ppm. for use as a sanitizer.

Example 16

| An Aqueous Bacteriocidal Composition | |
|---|---|
| The Concentrate of Example 5 | 4 |
| Pluronic L-64 | 19.2 |
| Water | 76.8 |

Contains 11,170 ppm. or 1.117% available iodine.

Example 17

| An Aqueous Bacteriocidal Composition | |
|---|---|
| The Concentrate of Example 11 | 10 |
| Water | 90 |

A 2.08% iodine solution usually diluted to 25 ppm. for sanitizing.

Example 18

| An Aqueous Bacteriocidal Composition | |
|---|---|
| The Concentrate of Example 11 | 5 |
| Water | 85 |
| Glycerine | 10 |

This is an excellent bovine teat dip for the control of bovine mastitis.

Example 19

| An Aqueous Bacteriocidal Composition | |
|---|---|
| The Concentrate of Example 12 | 5 |
| Pluronic L-64 | 5 |
| Water | 90 |

Contains 2% active iodine for further dilution if desired.

From the foregoing, it will be apparent that the present invention has made possible the provision of liquid iodine concentrates containing a much higher percentage of iodine than that previously attainable even at elevated temperatures. The concentrate is excellently suited to transportation and storage without the handling of vast quantities of water containing minute quantities of iodine. Further, the concentrate can be conditioned for rapid dissolving in water even at ambient temperatures by the addition of relatively small quantities of liquid detergents or other surfactants soluble in water. Thus, the provision of concentrated as well as dilute solutions of iodine in water is readily attainable without excessive mixing, agitation, or increased temperature.

While the product and method of the instant invention are described in terms of particular ingredients, and ranges thereof, to be used, it is obvious that modifications and variations in the nature and proportions of the ingredients may be made without departing from the spirit and scope of the invention, which is not to be limited to the illustrative details disclosed.

Having described my invention, what I claim as new and desire to secure by Letters Patent is:

1. A method of producing a water soluble iodine concentrate consisting essentially of dissolving 100 parts by weight of iodine in at least about 37 parts by weight of dimethyl sulfoxide, and dissolving the resultant system in a water solution surfactant selected from the group consisting of anionic and nonionic surfactants in an amount sufficient effectively to enhance the solubility of said system in water.

2. A method of producing an aqueous iodine solution consisting essentially of mixing iodine and dimethyl sulfoxide to form a first system in which the dimethyl sulfoxide is present in at least about 37% by weight of the iodine, mixing the first system with a water soluble surfactant selected from the group consisting of nonionic and anionic surfactants in an amount sufficient effectively to enhance the solubility of said system in water, to form a second system, and subsequently dissolving the second system in water in an amount sufficient to achieve a desired dilute solution.

3. A method of producing a water soluble iodine concentrate at ambient temperature consisting essentially of mixing iodine with dimethyl sulfoxide to form a first fluid organic complex, the dimethyl sulfoxide being present in at least about 37% by weight of the iodine; and thereafter mixing said first fluid complex with a water soluble surfactant selected from the group consisting of nonionic and anionic surfactants in an amount sufficient effectively to enhance the solubility of said system in water.

* * * * *

UNITED STATES PATENT AND TRADEMARK OFFICE

CERTIFICATE OF CORRECTION

PATENT NO. : 4,017,408

DATED : April 12, 1977

INVENTOR(S) : Elmer H. Fults

It is certified that error appears in the above-identified patent and that said Letters Patent are hereby corrected as shown below:

Column 3, line 10 delete "mols" and insert --- moles ---.

Column 6, line 57 delete "solution" and insert --- soluble ---.

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*